US007094059B2

(12) United States Patent
Obermeyer

(10) Patent No.: US 7,094,059 B2
(45) Date of Patent: Aug. 22, 2006

(54) CONNECTOR AND APPARATUS INCLUDING THE SAME

(75) Inventor: John R. Obermeyer, Campbell, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/849,091

(22) Filed: May 18, 2004

(65) Prior Publication Data

US 2004/0253841 A1 Dec. 16, 2004

Related U.S. Application Data

(63) Continuation of application No. 10/282,359, filed on Oct. 28, 2002, now Pat. No. 6,830,456.

(51) Int. Cl.
*H01R 39/00* (2006.01)

(52) U.S. Cl. ..... 439/6; 439/131; 439/23; 439/165; 248/917; 248/921; 248/923

(58) Field of Classification Search ..... 439/131, 439/6, 13, 165, 23, 24, 26; 248/917, 921, 248/923; 455/55; 361/680, 681, 683
See application file for complete search history.

(56) References Cited

U.S. PATENT DOCUMENTS 4,415,216 A 11/1983 Narozny
4,865,553 A 9/1989 Tanigawa et al.
4,904,189 A * 2/1990 Hallings ..... 439/13
4,919,387 A * 4/1990 Sampson ..... 248/371
4,986,507 A 1/1991 Chiang
5,016,849 A 5/1991 Wu
5,168,423 A 12/1992 Ohgami et al.
5,179,447 A 1/1993 Lain
5,206,790 A 4/1993 Thomas et al.
5,335,142 A 8/1994 Anderson
5,345,362 A 9/1994 Winkler
5,494,447 A 2/1996 Zaidan
5,608,604 A 3/1997 Francis
5,754,397 A * 5/1998 Howell et al. ..... 361/386
5,901,035 A 5/1999 Foster et al.
5,917,968 A 6/1999 Wood
5,947,440 A 9/1999 Cho
6,076,786 A * 6/2000 Meyer ..... 248/161
6,105,919 A 8/2000 Min
6,275,376 B1 * 8/2001 Moon ..... 361/683
6,347,433 B1 2/2002 Novin et al.
6,373,689 B1 4/2002 Yim
6,378,171 B1 4/2002 Suzuki et al.
6,409,541 B1 * 6/2002 Hattori et al. ..... 439/587
6,486,862 B1 * 11/2002 Jacobsen et al. ..... 345/88
6,510,049 B1 * 1/2003 Rosen ..... 361/681
6,549,789 B1 * 4/2003 Kfoury ..... 455/550.1
6,830,456 B1 12/2004 Obermeyer
6,867,961 B1 * 3/2005 Choi ..... 361/681
2002/0109962 A1 8/2002 Tseng et al.

* cited by examiner

*Primary Examiner*—Briggitte R. Hammond

(57) ABSTRACT

A connector for mechanically and electrically connecting devices such that the devices can pivot about two different axes relative to one another.

22 Claims, 7 Drawing Sheets

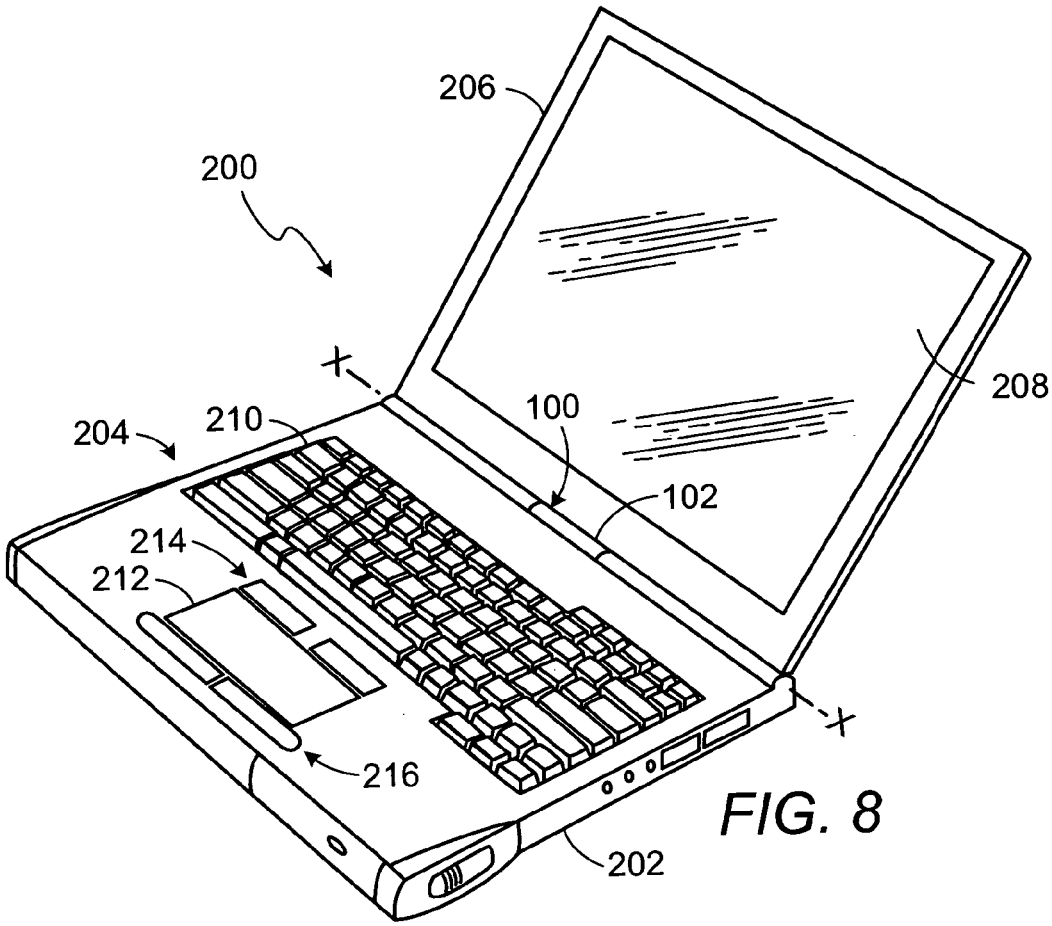
FIG. 8
FIG. 9
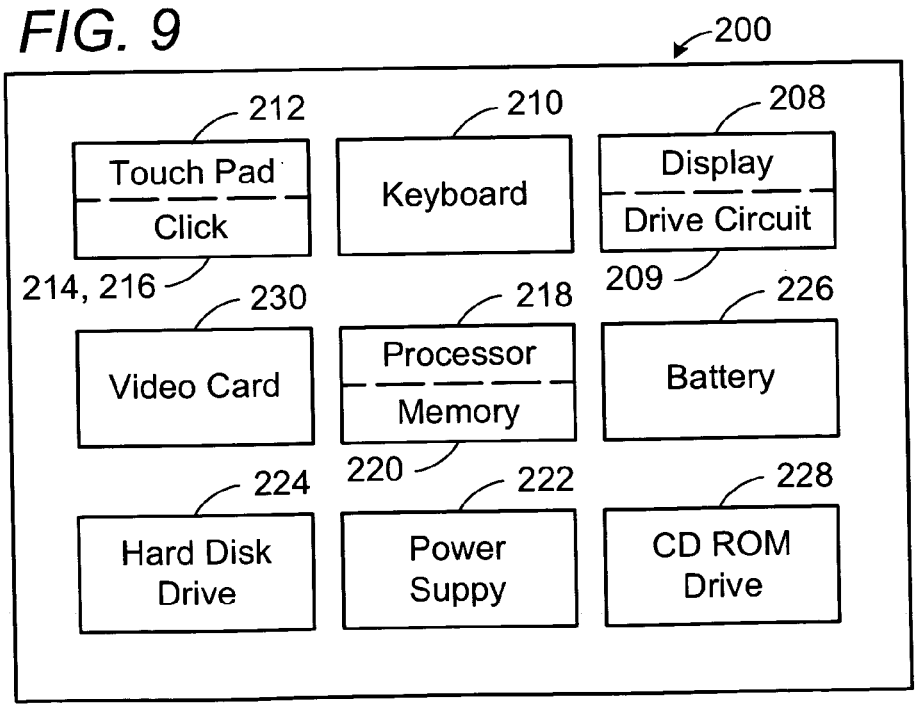

CONNECTOR AND APPARATUS INCLUDING THE SAME

CROSS-REFERENCE TO RELATED APPLICATIONS

This application is a continuation of U.S. application Ser. No. 10/282,359, filed Oct. 28, 2002 now U.S. Pat. No. 6,830,456, which is incorporated herein by reference.

BACKGROUND OF THE INVENTIONS

There are many instances where two or more devices are electrically connected to one another and, in addition, are mechanically connected such that the devices are movable relative to one another. Notebook computers, for example, include a display housing which supports the display and a main housing which supports the keyboard and houses various operating components. Typically, the display housing is pivotally connected to the main housing with a hinge, and is electrically connected to the main housing with a cable. The cable runs from the main housing to the display housing and is mechanically connected to the appropriate devices within the main housing and the display housing. More recently, notebook computers with display housings that are electrically, pivotally and rotatively connected to the main housing have also been proposed.

The inventor herein has determined that conventional arrangements for electrically, pivotally and rotatively connecting two or more devices (such as the display housing and main housing in a notebook computer) are susceptible to improvement. For example, the inventor named in the present application has determined that the use of a single cable that runs from the main housing to the display housing limits the rotational movement of the connected devices.

BRIEF DESCRIPTION OF THE DRAWINGS

Detailed description of preferred embodiments of the inventions will be made with reference to the accompanying drawings.

FIG. 8 is a perspective view of a portable computer in accordance with a preferred embodiment of a present invention in an open orientation.

FIG. 9 is a block diagram showing various operating components of the exemplary portable computer illustrated in FIG. 8.

DETAILED DESCRIPTION OF THE PREFERRED EMBODIMENTS

The following is a detailed description of the best presently known modes of carrying out the inventions. This description is not to be taken in a limiting sense, but is made merely for the purpose of illustrating the general principles of the inventions. Additionally, although the present inventions are applicable to, and even include, portable computers and stand alone monitors, the present inventions are not limited to portable computers and stand alone monitors or use therewith. Rather, the present inventions are applicable to any apparatus in which two or more devices are electrically and mechanically connected to one another.

Figure 1:
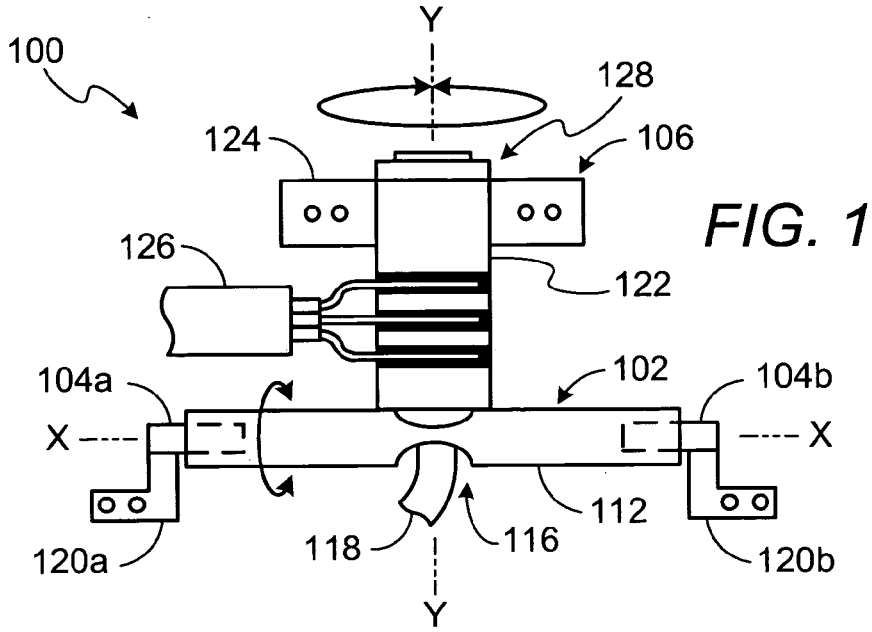
FIG. 1 is a front view of a hinged connector in accordance with a preferred embodiment of a present invention.
Figure 2:
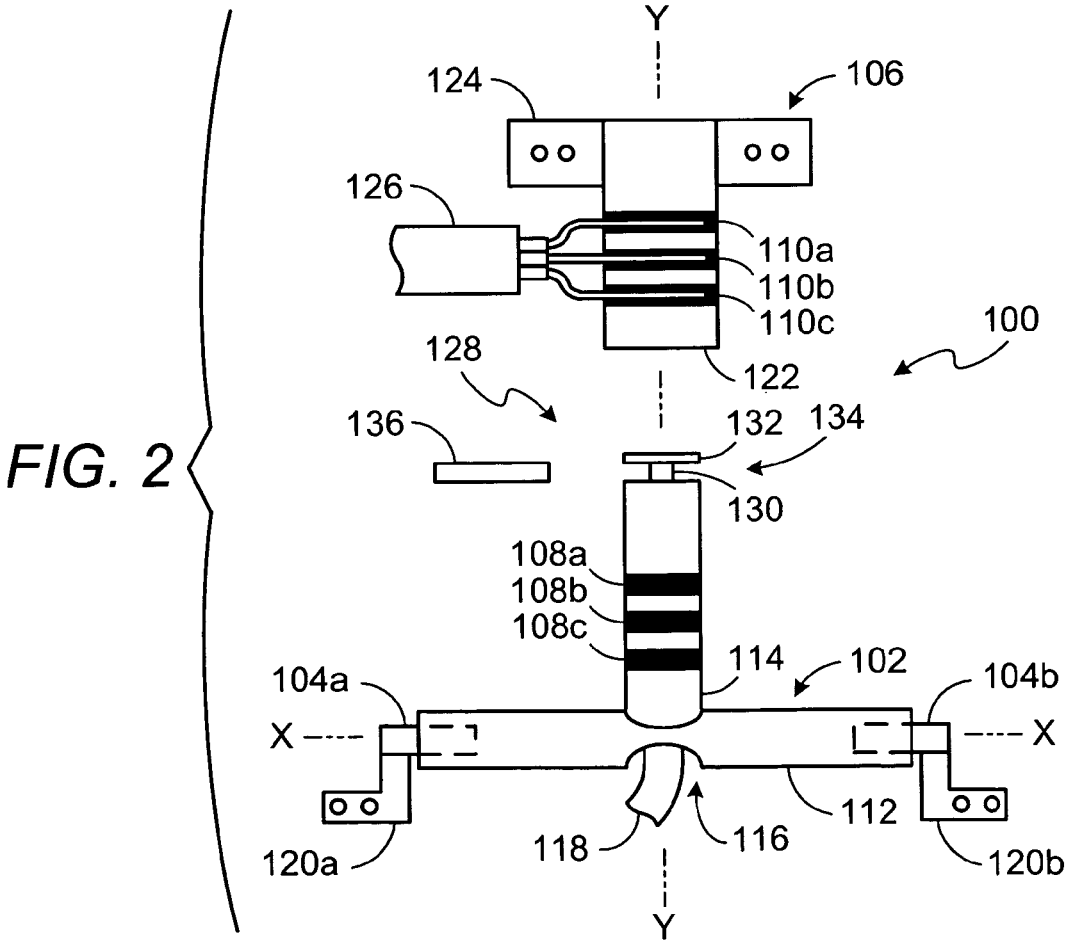
FIG. 2 is an exploded view of the exemplary hinged connector illustrated in FIG. 1.

As illustrated for example in FIGS. 1 and 2, a hinged connector 100 in accordance with a preferred embodiment of a present invention includes a first hinge member 102, which is pivotally carried by a pair of pivot pins 104*a* and 104*b*, and a second hinge member 106, which is pivotally carried by the first hinge member. The second hinge member 106 is preferably carried such that it is free to pivot 360° and beyond, which is referred to herein being "rotatable." The exemplary hinged connector 100 also includes a first set of electrical contacts 108*a–c* that are electrically connected to a second set of contacts 110*a–c*. The first and second sets of electrical contacts 108*a–c* and 110*a–c* are respectively carried by the first and second hinge members 102 and 106 such that the electrical connection is maintained as the first hinge member pivots and/or the second hinge member pivots and/or rotates. Additionally, although three contacts are carried by each of the hinge members in the exemplary embodiment, the number of contacts may be varied based on the intended application. Typical arrangements range from three to twelve contacts or more depending on the intended application.

The first hinge member 102 in the exemplary implementation includes a base 112 and a connector portion 114 that is carried by the base. Although not limited to any particular configuration, the exemplary base 112 is a cylindrical structure that is configured to receive the pins 104*a* and 104*b* at its longitudinal ends. So arranged, the base member 112 will pivot about the X-axis and the connector portion 114 (and second hinge member 106) will pivot with the base member. An opening 116 for an electrical cable 118 is also provided.

The exemplary connector portion 114, which carries the electrical contacts 108*a–c*, is also in the form of a hollow, cylindrical structure. The hollow aspect of the connector portion 114 allows individual wires from the cable 118 to be connected to the electrical contacts 108*a–c* in the manner described below with reference to FIG. 4. The pins 104*a* and 104*b* are respectively carried by mounting members 120*a* and 120*b*.

The second hinge member 106 in the exemplary implementation includes a connector portion 122 and mounting member 124. The exemplary connector portion 122, which carries the electrical contacts 110*a–c*, is a hollow, cylindrical structure that is configured to fit over the first hinge member connector portion 114 such that it is free to rotate about the Y-axis. Additionally, the outer diameter of the connector portion 114 corresponds to the inner diameter of the connector portion 122 in order to facilitate electrical transmission (by way of direct contact or capacitive coupling across a relatively small gap) between the contacts 108*a–c* and 110*a–c*, as described below with reference to FIGS. 4 and 4A. The tight fit between the connector portions 114 and 122 also creates enough friction force to keep the second hinge member 106 from pivoting or rotating about the Y-axis until the user desires to cause such pivoting or rotating. The individual wires from a cable 126 are connected to the contacts 110*a–c* in the manner described below with reference to FIGS. 5 and 6.

The X-axis and Y-axis, about which the first and second hinge members 102 and 106 pivot in the exemplary hinged connector 100 illustrated in FIGS. 1 and 2, are perpendicular to and intersect one another. It should be noted, however, that the present inventions are not limited to such an arrangement. The connector portion 114 could, for example, be L-shaped so that the X-axis and Y-axis do not intersect. The connector portion 114 could also be arranged at any angle other than perpendicular to the base member 112. Another alternative would be to vary the manner in which the first hinge member pivots. More specifically, instead of pivoting about the X-axis, which is coaxial with the longitudinal axis of the base member 112, the first hinge member could pivot about an axis that is perpendicular to both the X-axis and Y-axis, and passes though the base member near one of its longitudinal ends. Broadly speaking, other than being non-coaxial, the arrangement of the X-axis and the Y-axis may be perpendicular/intersecting (as shown) or may be any other arrangement dictated by the intended application.

The hinge members 102 and 106 in the exemplary hinged connector 100 may be secured to one another with any locking apparatus that fixes the relative positions of the connector portions 114 and 122 on the Y-axis, while still allowing the connector portion 122 to rotate about the connector portion 114. One example of such a locking apparatus is the locking apparatus 128 in the illustrated embodiment. Referring to FIGS. 2–3C, the exemplary locking apparatus 128 includes a post 130 and disk 132, which are carried by the connector portion 114 such that a space 134 is defined between the connector portion and the disk, and a snap ring 136. The snap ring 136 includes a central opening 138 that is configured to receive the post 130 and a slot 140 though which the post passes. The thickness of the snap ring 136 is approximately equal to the distance between the connector portion 114 and the disk 132 and the outer diameter of the snap ring is at least as large as the outer diameter of the connector portion 122.

Figure 3A:
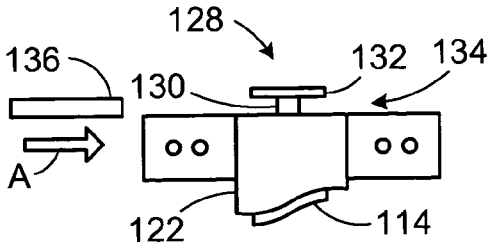
FIGS. 3A–3C are top views showing a portion of an exemplary method of assembling the exemplary hinged connector illustrated in FIG. 1.
Figure 3B:
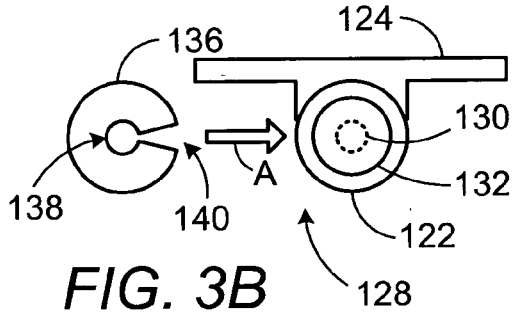
Figure 3C:
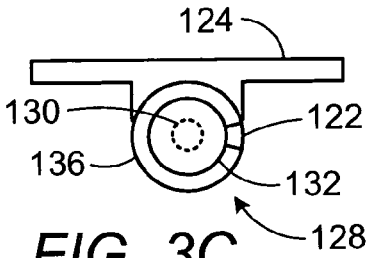

Referring more specifically to FIGS. 3A–3C, once the hinge member 106 has been placed over the hinge member 102 and the top surfaces of the connector portions 114 and 122 are aligned, the snap ring 136 may be moved in the direction of arrow A from the position shown in FIGS. 3A and 3B to the position shown in FIG. 3C. The snap ring 136 will deflect outwardly as it moves into the space 134 and the post 130 passes through the slot 140 into the central opening 138. Once the post 130 is entirely within the central opening 138 (FIG. 3C), the snap ring 136 will deflect back to its original state, thereby locking itself around the post. The snap ring 136 will also be located between (and preferably engage) the top surface of the connector portion 114 and the bottom surface of the disk 132, thereby preventing the hinge member 106 from moving away from the hinge member 102 along the Y-axis.

Figure 4:
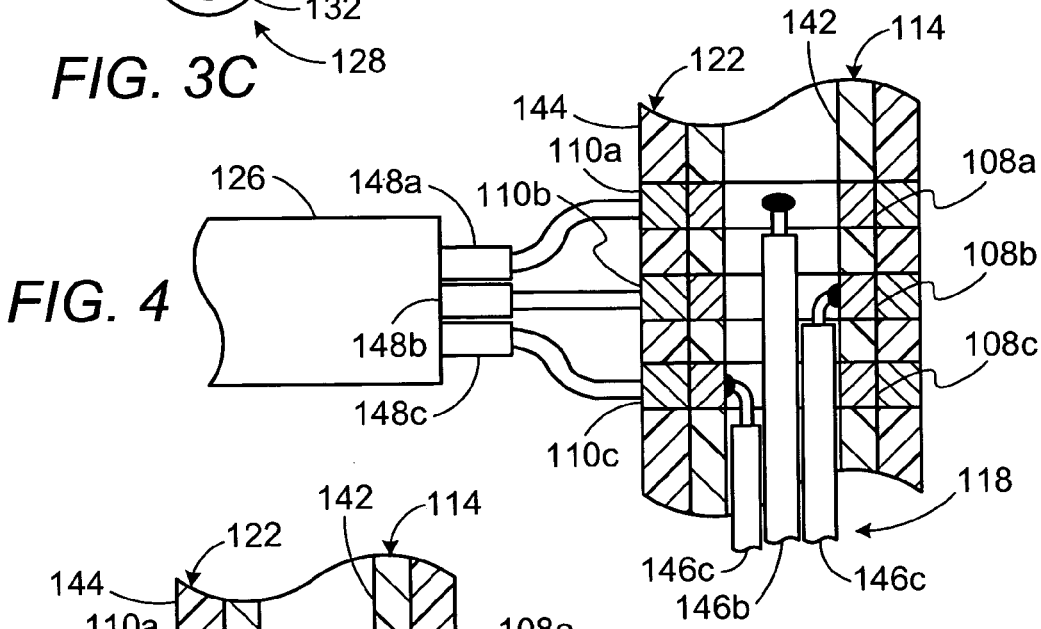
FIG. 4 is a front, partial section view of a portion of the exemplary hinged connector illustrated in FIG. 1.
Figure 4A:
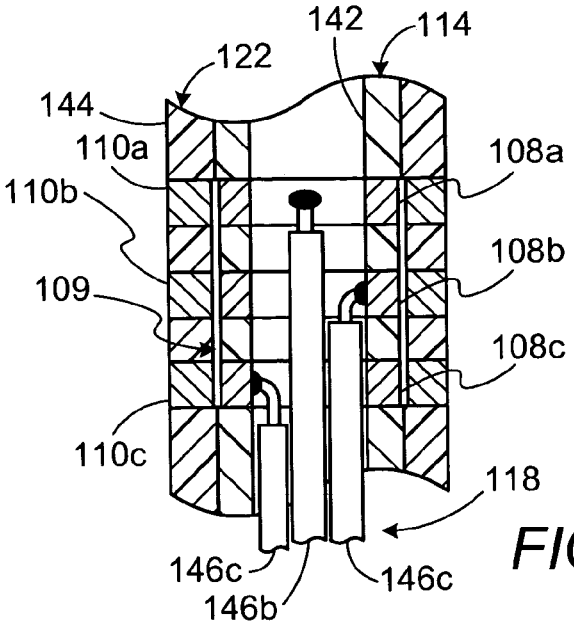
FIG. 4A is a front, partial section view of a portion of another exemplary hinged connector.

The connector portions 114 and 122 in the exemplary implementation are substantially similar in structure. More specifically, and as illustrated for example in FIG. 4, the connector portions 114 and 122 consist essentially of respective cylindrically-shaped insulator portions 142 and 144 that are interspersed above, below and between the electrical contacts 108*a–c* and 110*a–c*. The insulator portions 142 and 144 may be formed from suitable dielectric materials such as, for example, polyimide material and other plastics. The contacts 108*a–c* and 110*a–c* are preferably formed from materials, such as conductive metals and metal impregnated plastics, which have good conductive properties. One set of contacts (i.e. either contacts 108*a–c* or contacts 110*a–c*) will also preferably be provided with brushes (not shown) that facilitate physical contact with the other set of contacts to form the electrical connection. Alternatively, in instances such as the transmission of high frequency signals where a capacitive coupling-type electrical connection is desired, there will be a relatively small gap 109 between the contacts 108*a–c* and 110*a–c*, as illustrated in FIG. 4A. The size of the gap 109 will depend on factors such as the size of the contacts 108*a–c* and 110*a–c* as well as the magnitude and frequency of the electrical signals.

Figure 5:
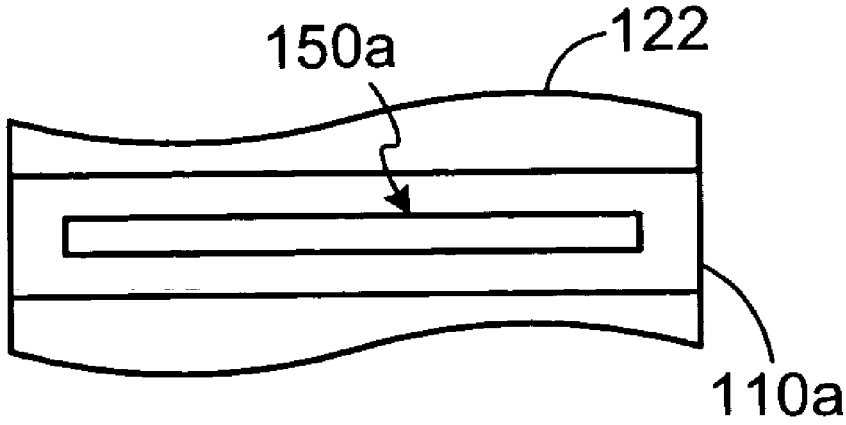
FIG. 5 is a front view of a portion of the exemplary hinged connector illustrated in FIG. 1.
Figure 6:
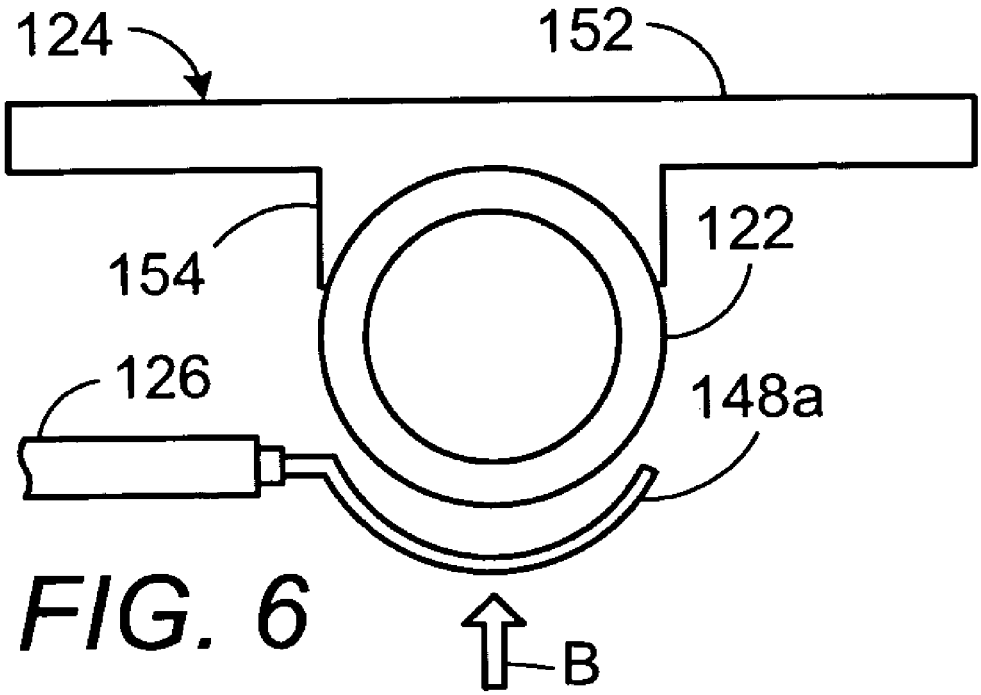
FIG. 6 is a top view showing a portion of an exemplary method of assembling the exemplary hinged connector illustrated in FIG. 1.

As noted above, the individual wires from the cable 118 are connected to the electrical contacts 108*a–c* on the exemplary hinge member 102. More specifically, and as illustrated in FIG. 4, individual wires 146*a–c* from the cable 118 may be respectively connected to the inner surfaces of the contacts 108*a–c* by, for example, removing a portion of the insulation from each wire and soldering the wires to the inner surfaces of the associated contacts. Other methods of connecting the wires to the contacts include press fitting and welding. Turning to the exemplary hinge member 106, individual wires 148*a*–148*c* from the cable 126 are preferably connected to the exterior of the contacts 110*a*–110*c*. This may be accomplished by, for example, removing a portion of the insulation from each wire 148*a–c* and soldering the wires to the outer surfaces of the associated contacts 110*a–c*. Alternatively, and as illustrated for example in FIG. 5, each of the contacts 110*a*–110*c* may be provided with an exterior wire slot (only slot 150*a* is shown in FIG. 5). The wires 148*a–c* may be press fit into the slots by aligning them with the slots and then urging them in the direction indicated by arrow B in FIG. 6.

The present hinged connector may be used to secure a wide variety of devices to one another. The configuration of the mounting members that secure the hinged connector to the devices will, therefore, depend on the intended application. In the exemplary implementation illustrated in FIGS. 1–6, the mounting members 120*a* and 120*b* are generally L-shaped and the ends opposite the pins 104*a* and 104*b* include a plurality of holes for screws or other fasteners. The mounting member 124 includes a generally planar portion 152 (note FIG. 6) with a plurality of holes for screws or other fasteners and a portion 154 that extends from the planar portion to the hinge member connector portion 122. The connector portion 122 and mounting member 124 may be an integrally formed unit or separate structural elements that are secured to one another.

The exemplary hinged connector 100 is shown in FIGS. 7A–7F in combination with, and is electrically and mechanically connecting, a first device 156 and a second device 158. On the electrical side, the cable 118 in the first device 156 is electrically (but not mechanically) connected to one end of the cable 126 in the second device 158 by way of the hinged connector 100, and the other end of the cable 126 is connected to an internal apparatus 160 within the second device. With respect to the mechanical connection, the mounting members 120*a* and 120*b* connect the first hinge member 102 to the first device 156, the mounting member 124 connects the second hinge member 106 to the second device 158, and the first and second hinge members are connected to one another by the exemplary locking apparatus 128. [Note FIG. 7B.]

Figure 7A:
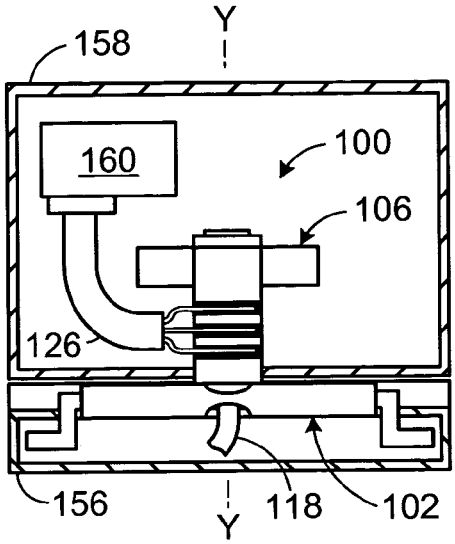
FIGS. 7A–7F are front and side cutaway views showing various orientations of a pair of devices connected by the exemplary hinged connector illustrated in FIG. 1.
Figure 7B:
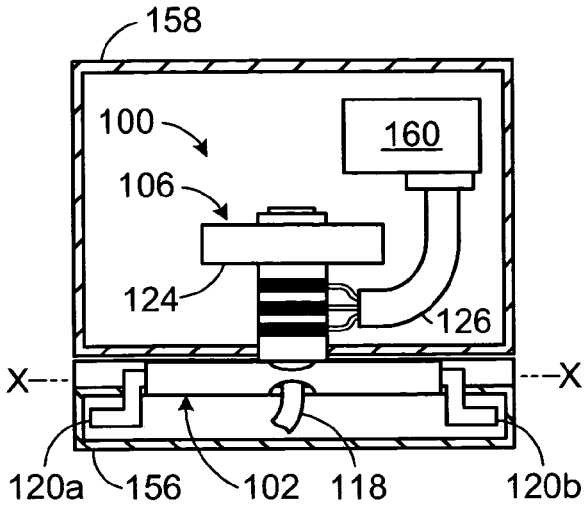
Figure 7C:
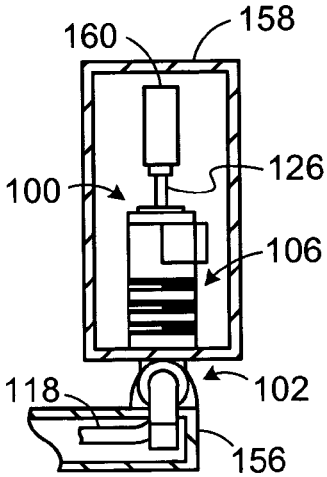
Figure 7D:
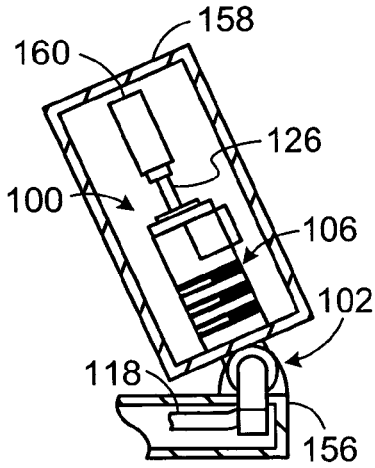
Figure 7E:
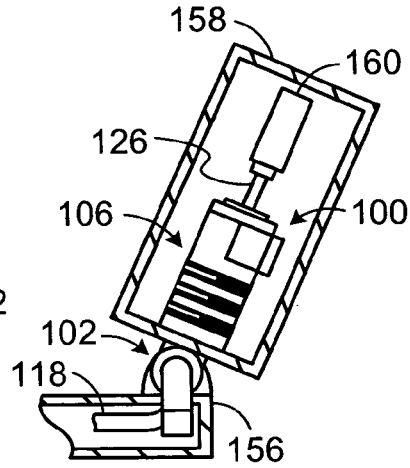
Figure 7F:
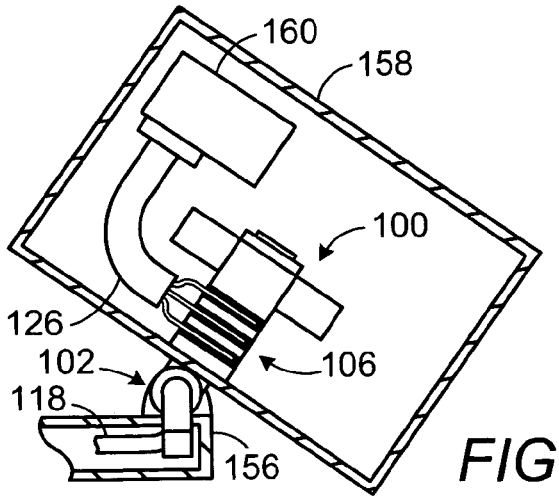
Figure 10:
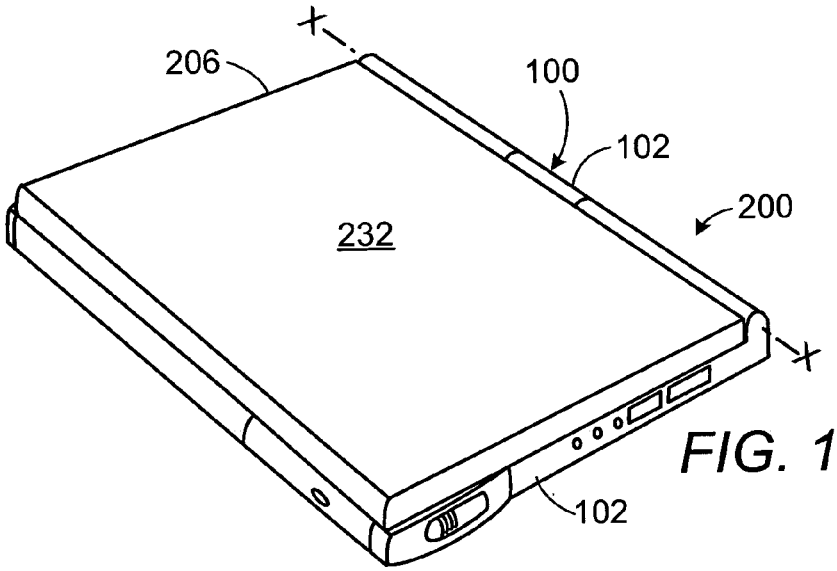
FIG. 10 is a perspective view of the exemplary portable computer illustrated in FIG. 8 in a closed orientation with the display facing the keyboard.
Figure 11:
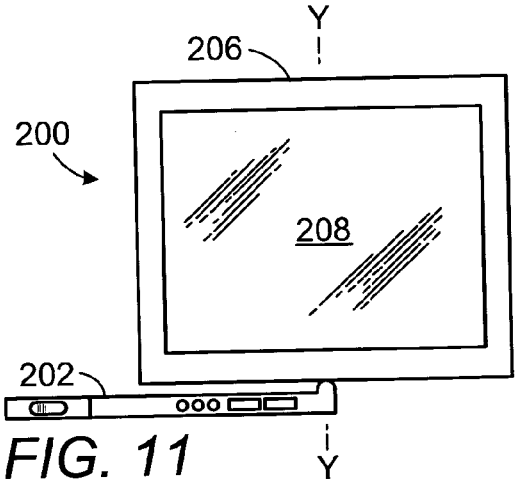
FIG. 11 is a side view of the exemplary portable computer illustrated in FIG. 8 in an open orientation with the display rotated.

Referring to FIGS. 7A and 7B, when the second device 158 is pivoted 180 degrees about the Y-axis relative to the first device 156, the second hinge member 106 and cable 126 will simply pivot along with the second device. The second hinge member 106 and cable 126 will continue to pivot with the second device 158 as the second device continues to pivot in the same direction until it reaches the orientation illustrated in FIG. 7A, thereby completing a full rotation, and beyond. Alternatively, the second device 158 may be pivoted in the opposite direction. In either case, the cables 118 and 126, which are not mechanically secured to one other, and are instead electrically connected by way of the contacts 108*a–c* and 110*a–c*, will not be pulled or twisted and the electrical connection therebetween will be maintained no matter now many times the second device 158 is rotated relative to the first device 156. Turning to FIGS. 7C–7E, the second device 158 may also be pivoted back and forth relative to the first device 156 about the X-axis without substantial pulling on the cable 118 and without any pulling on the cable 126. Here too, the electrical connection between the cables 118 and 126 will be maintained by the contacts 108*a–c* and 110*a–c*. The second device 158 may also be pivoted relative to the first device 156 about the X-axis in addition to being pivoted or rotated about the Y-axis in, for example, the manner illustrated in FIG. 7F without substantial pulling or twisting on the cables 118 and 126 or loss of the electrical connection provided by the contacts 108*a–c* and 110*a–c*.

With respect to manufacture, manufacture of the exemplary hinged connector 100 is not limited to any particular method. For example, the hinge members 102 and 106 may be respectively formed from a plurality of individual elements (i.e. the contacts 108*a–c*, base member 112 and connector insulator portions 142; and the contacts 110*a–c*, mounting member 124 and connector insulator portions 142) that are secured to one another with an adhesive during assembly. The hinge members 102 and 106 may also formed by a molding process wherein the contacts 108*a–c* and 110*a–c* are placed into the respective molds prior to injection of the material that forms the remainder of the hinge members. In either case, it is preferable (but not necessary) that the wires 146*a–c* from the cable 118 be secured to the contacts 108*a–c* prior to assembly or molding.

The present hinged connector has a wide variety of applications. Although the present inventions are not limited to any particular type of device, one embodiment of an invention that may include the present hinged connector is the exemplary notebook style portable computer 200 illustrated in FIGS. 8 and 9. It should be noted that detailed discussions of various conventional internal operating components of computers which are not pertinent to the present inventions have been omitted for the sake of simplicity. Nevertheless, the exemplary portable computer 200 is, with respect to many of the structural and operating components, substantially similar to conventional portable computers such as the Hewlett-Packard Omnibook 6000 notebook PC. More specifically, the exemplary portable computer 200 includes structural components such as a two-part housing that consists of main housing 202, which supports a user interface 204 and houses various operating components, and a display housing 206, which supports a display 208. The user interface 204 allows the user to control the operations of the computer and, to that end, is provided with a keyboard 210, a touch pad 212, a first pair of right/left click buttons 214 and a second pair of right/left click buttons 216. The rear end of the main housing 202 is mechanically connected to the rear end of the display housing 206 by the exemplary hinged connector 100. The hinged connector 100, which also electrically connects elements within the main housing 202 to elements within the display housing 206, allows the main housing 202 and display housing 206 to pivot and rotate relative to one another in the manner described below with reference to FIGS. 10-13.

With respect to the operating components, and referring more specifically to FIG. 9, the main housing 202 houses a CPU (or "processor") 218, cache and RAM memory 220, a power supply 222, a hard disk drive 224, and a battery 226. A module bay for optional modules such as a CD-ROM drive module 228, a 3.5 inch disk drive module, or a ZIP drive module is also provided within the main housing 202. The exemplary portable computer 200 may also include other conventional components such as, for example, a modem, an audio card, a video card 230, headphone and microphone ports, serial, parallel and USB ports, keyboard and mouse ports, a 240-pin PCI connector for docking, an operating system such as Microsoft® Windows, and various application programs such a word processing, spreadsheets, security programs and games. In addition to the display 208, the display housing 206 also includes a drive circuit 209 for the display.

Figure 12:
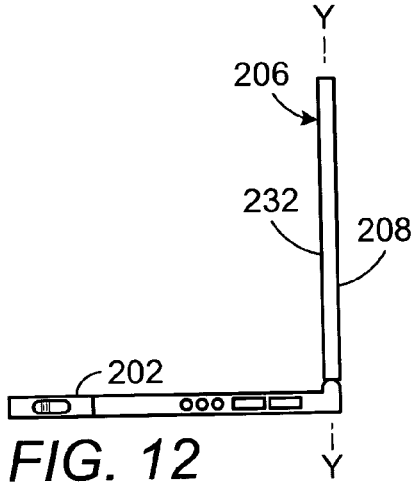
FIG. 12 is a side view of the exemplary portable computer illustrated in FIG. 8 in an open orientation with the display rotated.
Figure 13:
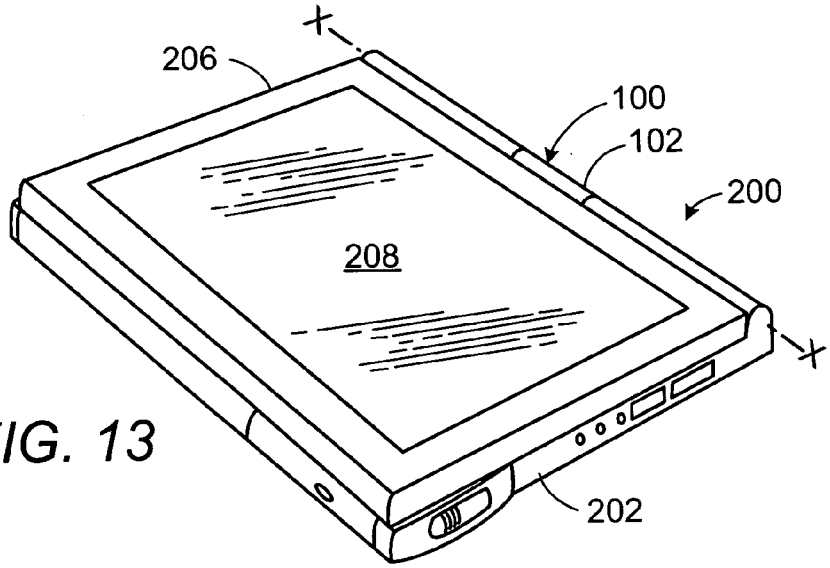
FIG. 13 is a perspective view of the exemplary portable computer illustrated in FIG. 8 in a closed orientation with the display facing away from the keyboard.
Figure 14:
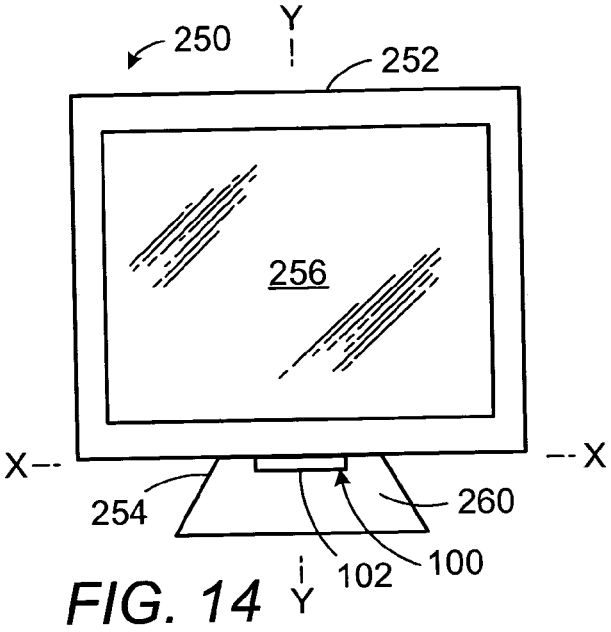
FIG. 14 is a front view of a display in accordance with a preferred embodiment of a present invention.
Figure 15:
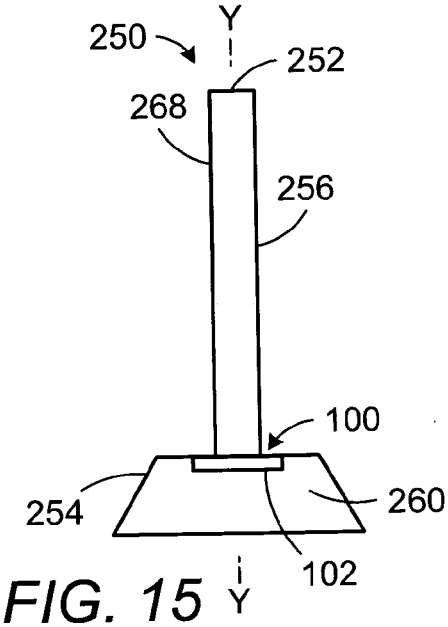
FIG. 15 is a front view of the exemplary display illustrated in FIG. 14 with the display housing rotated relative to the base.
Figure 16:
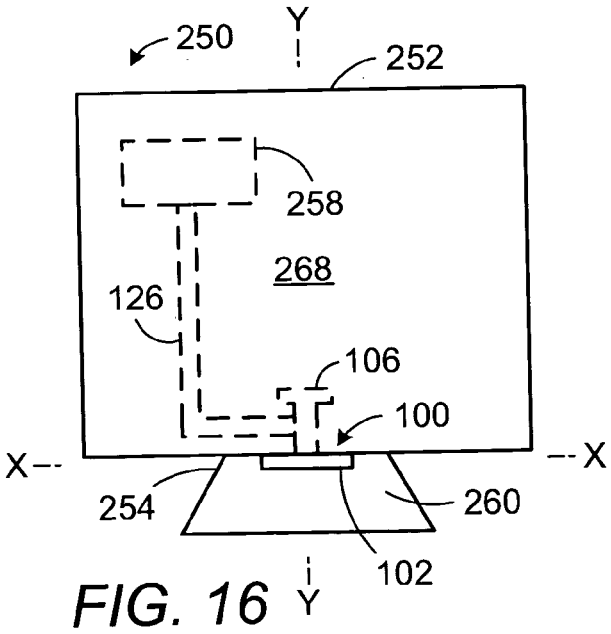
FIG. 16 is a front view of the exemplary display illustrated in FIG. 14 with the display housing rotated relative to the base.
Figure 17:
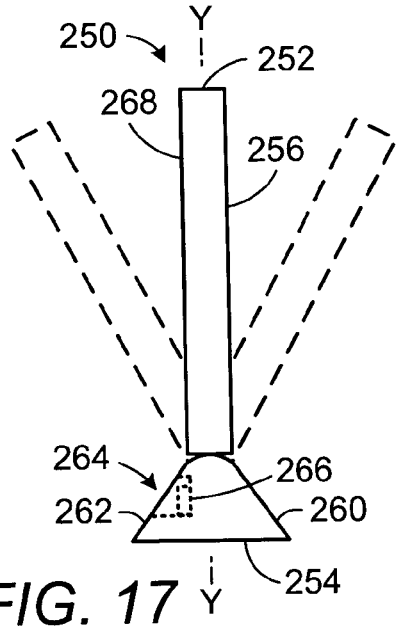
FIG. 17 is a side view of the exemplary display illustrated in FIG. 14.

The exemplary hinged connector 100 is used to electrically (signals and power) connect the video card 230 in the main housing 202 to the drive circuit 209 for the display 208. More specifically, the video card 230 may be operably connected to the cable 118 and the drive circuit may be operably connected to the cable 126. The exemplary hinged connector 100 also allows the display housing to be positioned in a variety of orientations relative to the main housing. As illustrated for example in FIG. 8, the display housing 206 may be pivoted about the X-axis in order to provide access to the user interface 204 and the display 208. The display housing 206 may also be pivoted to the orientation illustrated in FIG. 10 such that the display faces the user interface 204 and the rear side 232 of the display housing is exposed. The display housing 206 may also be rotated about the Y-axis in addition to the X-axis. For example, as compared to the orientation illustrated in FIG. 10, the display housing 206 illustrated in FIG. 11 has been pivoted 90 degrees about the X-axis and 90 degrees about the Y-axis. In FIG. 12, the display housing has been pivoted an additional 90 degrees about the Y-axis (i.e. 180 degrees from the orientation in FIG. 10). The display housing 206 may be pivoted an additional 180 degrees to complete a full rotation (and return the display housing 206 to the orientation illustrated in FIG. 8), and as far beyond as the user desires, due to the use of the exemplary hinged connector 100.

The exemplary portable computer 200 may also be used in a tablet computer mode in those instances where the display 208 is a touch screen display. The display housing 206 can be pivoted about the X-axis, from the orientation illustrated in FIG. 12 to the orientation illustrated in FIG. 13, so that the rear side 232 of the display housing faces the user interface 204 and the display 208 faces the user.

Another embodiment of an invention that may include the present hinged connector is the exemplary monitor 250 illustrated in FIGS. 14–17. It should be noted that detailed discussions of various conventional operating components of monitors which are not pertinent to the present inventions have been omitted for the sake of simplicity. The exemplary monitor 250 includes a housing 252 and a base 254 that are mechanically and electrically connected to one another by the exemplary hinged connector 100. The housing 252 supports a display 256 and houses the other operating components of the monitor 250, such as a drive circuit 258, while the base 254 supports the housing on a desktop or other surface. The base has a front side 260 and a rear side 262 and the rear side includes an opening 264 and a port 266 to which a connector cable from a data source such as, for example, a computer may be connected. In the exemplary implementation, the hinge member 102 is secured to the base 254 and the hinge member 106 is secured to the housing 252. The cable 118 (note FIG. 1) is operably connected to port 266, while the cable 126 is operably connected to the drive circuit 258. Due to the electrical connection between the hinge members 102 and 106, signals received by the connector 226 will be transferred to the drive circuit 258.

In addition to providing the aforementioned electrical connection, the exemplary hinged connector 100 allows the housing 252 to be positioned in a variety of orientations relative to the base 254. As illustrated for example in FIG. 14, the housing 252 may be oriented about the Y-axis such that it faces in the same direction as the base front side 260 and is oriented about the X-axis such that the Y-axis is perpendicular to the surface on which the base is resting. The housing 252 may also be pivoted about the Y-axis from the orientation illustrated in FIG. 14 to the orientation illustrated in FIG. 15, to the orientation illustrated in FIG. 16 where the housing rear side 268 is facing in the same direction as the base front side 260, back to the orientation illustrated in FIG. 14 to complete a full rotation, and as far beyond as the user desires. The housing 252 may also be pivoted about the X-axis in the manner illustrated in FIG. 17. Additionally, as described above with reference to FIG. 7F, the housing 252 may be simultaneously pivoted about the X-axis and Y-axis.

Although the present inventions have been described in terms of the preferred embodiments above, numerous modifications and/or additions to the above-described preferred embodiments would be readily apparent to one skilled in the art. It is intended that the scope of the present inventions extend to all such modifications and/or additions.

I claim:

1. A connector, comprising:

a first member including an electrical contact and pivotable about a first axis; and a second member including an electrical contact and pivotable about a second axis that is non-coaxial with the first axis;

the first member electrical contact and the second member electrical contact defining separate structural elements;

the first and second members being mechanically connected to one another such that the first member electrical contact and the second member electrical contact will be in close enough proximity to one another that a direct electrical connection will be maintained between the first member electrical contact and the second member electrical contact as the first member pivots about the first axis and the second member pivots about the second axis.

2. A connector as claimed in claim 1, wherein the first and second members include insulator portions that respectively carry the first member electrical contact and the second member electrical contact.

3. A connector as claimed in claim 1, wherein the first member includes a plurality of electrical contacts and the second member includes a corresponding plurality of electrical contacts.

4. A connector as claimed in claim 1, further comprising:

a first cable connected to the first member electrical contact; and a second cable connected to the second member electrical contact.

5. A connector as claimed in claim 1, wherein the first member includes a first member connector portion that defines the second axis and carries the first member electrical contact, and the second member includes a second member connector portion that carries second member electrical contact and is rotatably mounted on the first member connector portion.

6. A connector as claimed in claim 1, wherein the second axis is perpendicular to the first axis.

7. A connector as claimed in claim 1, wherein the second axis is not parallel to the first axis.

8. An apparatus, comprising:

a first housing that includes a first electrical device;

a second housing that includes a second electrical device; and a connector including a first member secured to the first housing, pivotable about a first axis, and including an electrical contact connected to the first electrical device, and a second member secured to the second housing, pivotable about a second axis that is non-coaxial with the first axis, and including an electrical contact connected to the second electrical device, the first member electrical contact and the second member electrical contact defining separate structural elements, and the first and second members being mechanically connected to one another such that the first member electrical contact and the second member electrical contact will be in close enough proximity to one another that a direct electrical connection will be maintained between the first member electrical contact and the second member electrical contact as the first member pivots about the first axis and the second member pivots about the second axis.

9. An apparatus as claimed in claim 8, further comprising:

a display carried by one of the first and second housings; and a keyboard carried by the other of the first and second housings.

10. An apparatus as claimed in claim 8, wherein the first and second members include insulator portions that respectively carry the first member electrical contact and the second member electrical contact.

11. An apparatus as claimed in claim 1, wherein the first member includes a plurality of electrical contacts and the second member includes a corresponding plurality of electrical contacts.

12. An apparatus as claimed in claim 1, further comprising;

a first cable connected to the first member electrical contact; and a second cable connected to the second member electrical contact.

13. An apparatus as claimed in claim 1, wherein the first member includes a first member connector portion that defines the second axis and carries the first member electrical contact, and the second member includes a second member connector portion that carries second member electrical contact and is rotatably mounted on the first member connector portion.

14. An apparatus as claimed in claim 8, wherein the second axis is perpendicular to the first axis.

15. An apparatus as claimed in claim 8, wherein the second axis is not parallel to the first axis.

16. A monitor, comprising:

a display housing including a display;

a base configured to support the display housing and including a port; and a connector including a first member secured to the base, pivotable about a first axis, and including an electrical contact operably connected to the port, and a second member secured to the display housing, pivotable about a second axis that is non-coaxial with the first axis, and Including an electrical contact associated with the display, the first member electrical contact and the second member electrical contact defining separate structural elements, the first and second members being mechanically connected to one another such that the first member electrical contact and the second member electrical contact will be in close enough proximity to one another that a direct electrical connection will be maintained between the first member electrical contact and the second member electrical contact as the first member pivots about the first axis and the second member pivots about the second axis.

17. A monitor as claimed in claim 16, wherein the first and second members include insulator portions that respectively carry the first member electrical contact and the second member electrical contact.

18. A monitor as claimed in claim 16, wherein the first member includes a plurality of electrical contacts and the second member includes a corresponding plurality of electrical contacts.

19. A monitor as claimed in claim 16, further comprising:

a first cable connected to the first member electrical contact and to the port; and a second cable connected to the second member electrical contact and associated with the display.

20. A monitor as claimed in claim 16, wherein the first member includes a first member connector portion that defines the second axis and carries the first member electrical contact, and the second member includes a second member connector portion that carries second member electrical contact and is rotatably mounted on the first member connector portion.

21. A monitor as claimed in claim 16, wherein the second axis is perpendicular to the first axis.

22. A monitor as claimed in claim 16, wherein the second axis is not parallel to the first axis.

* * * * *

UNITED STATES PATENT AND TRADEMARK OFFICE

CERTIFICATE OF CORRECTION

PATENT NO. : 7,094,059 B2
APPLICATION NO. : 10/849091
DATED : August 22, 2006
INVENTOR(S) : John R. Obermeyer It is certified that error appears in the above-identified patent and that said Letters Patent is hereby corrected as shown below:

In column 9, line 3, in Claim 11, delete “claim 1” and insert -- claim 8 --, therefor.

In column 9, line 7, in Claim 12, delete “claim 1” and insert -- claim 8 --, therefor.

In column 9, lines 7-8, in Claim 12, delete “comprising;” and insert -- comprising: --, therefor.

In column 9, line 13, in Claim 13, delete “claim 1” and insert -- claim 8 --, therefor.

In column 9, line 34, in Claim 16, delete “Including” and insert -- including --, therefor.

Signed and Sealed this

Third Day of March, 2009

John Doll

JOHN DOLL
*Acting Director of the United States Patent and Trademark Office*